US007322058B2

(12) United States Patent
Long

(10) Patent No.: US 7,322,058 B2
(45) **Date of Patent: *Jan. 29, 2008**

(54) ADJUSTABLE BED WITH MASSAGE MOTOR

(75) Inventor: Thomas P. Long, Webb City, MO (US)

(73) Assignee: L & P Property Management Company, South Gate, CA (US)

( * ) Notice: Subject to any disclaimer, the term of this patent is extended or adjusted under 35 U.S.C. 154(b) by 86 days.

This patent is subject to a terminal disclaimer.

(21) Appl. No.: 11/380,309

(22) Filed: Apr. 26, 2006

(65) Prior Publication Data

US 2006/0230529 A1 Oct. 19, 2006

Related U.S. Application Data

(63) Continuation-in-part of application No. 11/108,995, filed on Apr. 19, 2005, now Pat. No. 7,039,970.

(51) Int. Cl.
*A47G 7/15* (2006.01)
*A61H 7/00* (2006.01)

(52) U.S. Cl. ..... 5/600; 5/933; 601/56; 601/601; 601/59

(58) Field of Classification Search ..... 601/49–54, 601/56, 58, 59, 86, 90, 98; 5/108, 109, 915, 5/933

See application file for complete search history.

(56) References Cited

U.S. PATENT DOCUMENTS

| | | | | |
|---|---|---|---|---|
| 3,613,673 | A | 10/1971 | La Hue | |
| 5,014,687 | A | 5/1991 | Raffel | |
| 5,140,977 | A | 8/1992 | Raffel | |
| 5,170,522 | A | 12/1992 | Walker | |
| 5,577,280 | A | 11/1996 | Elliott | |
| 6,101,647 | A | 8/2000 | Stroud et al. | |
| 6,499,161 | B1 | 12/2002 | Godette | |
| 6,684,423 | B2 | 2/2004 | Godette | |
| 6,708,358 | B2 | 3/2004 | Hensley | |
| 6,723,059 | B1 | 4/2004 | Park | |
| 7,039,970 | B1 * | 5/2006 | Long | 5/600 |

* cited by examiner

*Primary Examiner*—Michael Trettel
(74) *Attorney, Agent, or Firm*—Wood, Herron & Evans, LLP

(57) ABSTRACT

An adjustable bed having an upper frame mounted to translate with respect to a lower frame. A center support is connected to the upper frame and has a head support pivotally connected to one end thereof. A thigh support is pivotally connected to the other end of the center support and a foot support is connected to the other end of the thigh support. The bed includes an improved mounting for a massage motor in which a massage motor is suspended from a mounting plate having openings therein resting on a mattress pad or base supported by an articulated support platform.

19 Claims, 4 Drawing Sheets

ADJUSTABLE BED WITH MASSAGE MOTOR

CROSS REFERENCE TO RELATED APPLICATIONS

This application is a continuation-in-part of U.S. patent application Ser. No. 11/108,995, filed Apr. 19, 2005 entitled "Adjustable Bed", now U.S. Pat. No. 7,039,970, which is fully incorporated by reference herein.

FIELD OF THE INVENTION

This invention relates generally to adjustable beds and more particularly, to improvements to adjustable beds.

BACKGROUND OF THE INVENTION

Adjustable beds have been used for many years to permit the user to adjust the head and foot sections of the bed to different positions. While originally only manually adjustable, more recently, the head and foot sections are moved by motors operated by the user via a remote control.

Adjustable beds were originally designed principally for use in medical environments by patients who had to spend long periods of time in bed for reasons of health, injury, etc. However, more recently, adjustable beds are also being used in residential environments by users who have no health or physical impairment. An increasing number of people place televisions and other entertainment devices in the bedroom, and more time is spent lounging in bed. Hence, the bed, and in particular, an adjustable bed, is considered by many users an alternative piece of leisure furniture. As the market for leisure beds grows, there is continuing effort by suppliers to provide leisure beds that are more comfortable, have more options, for example, massage capabilities, more sophisticated controls, and are more affordable.

One recent development in adjustable beds is the development of a "wallhugger" adjustable bed. The wallhugger adjustable bed maintains the user in the same position with respect to adjacent appliances and furniture as the head portion of the bed is moved between flat and elevated positions. To achieve that purpose, as the head section pivots upward, an upper bed frame portion translates toward the head end of the bed with respect to a stationary lower bed frame section.

Almost all adjustable beds utilize one or more massage motors which are controllable by a user to provide a massaging action while the user is in the bed. In one embodiment, a massage motor is rigidly connected to an underside of a rigid platform, for example, a head board or a foot board, that is hinged to a centerboard or platform. Further, the whole articulated platform normally supports a mattress base, for example, a foam pad approximately 4 inches thick over which is placed beneath a mattress. Thus, any vibration applied to the underside of the head board must vibrate the whole head board; and further, the vibration is partially absorbed and attenuated by the soft materials in the mattress base and the mattress. The resulting or net vibration applied to a user lying on the mattress is often substantially less than is desired. In other designs, the massage motor is rigidly mounted to a resonator board that is inserted into a centrally located slit and cutout portion of the mattress base. The resonator board is then bonded to an interior surface within the slit in the mattress base, and the massage motor extends downward through the cutout in the mattress base and a contiguous cutout in the platform supporting the mattress base and the mattress. As with the former design, the vibrating action of the massage motor is substantially attenuated by the thick foam mattress base.

Thus, there is a need for an improved bed structure for more effectively transmitting massaging actions or vibrations from a massage motor to a user lying on the bed.

SUMMARY OF THE INVENTION

The present invention provides an adjustable bed having an improved massage capability, thereby increasing the satisfaction of the user with the bed. The adjustable bed of the present invention is especially useful when multiple massage motors are incorporated into the bed.

According to the principles of the present invention and in accordance with one embodiment, the adjustable bed of the present invention has a bed frame and a support section supported by the bed frame and adapted to support a mattress and a user laying on such mattress. The bed further has a mounting plate located on an upper surface of a mattress pad or base, and a massage motor mounted to and suspended by the mounting plate. This massage motor mounting structure greatly improves the transmission of vibrations created by the massage motor to a user laying on a mattress resting on the mattress pad or base.

In accordance with one aspect of the invention, the adjustable bed has a mattress base or pad having a thickness of approximately one inch for covering the support section. The mattress base may be made of any suitable material but is usually made of foam or fiber. In accordance with another aspect of the invention, the mounting plate is supported by the mattress base on the upper surface thereof; and the massage motor is suspended therefrom. Thus, the mounting plate is mounted such that vibrations from the massage motor are transmitted directly to the mounting plate and on to the mattress. The mounting mechanism reduces or eliminates any transfer of vibration to the adjustable bed frame or support platform.

In accordance with another aspect of the invention, the mounting plate may have at least one opening therein. Consequently, such mounting plate is made of less material and therefore less expensive to manufacture than a solid mounting plate.

In accordance with another aspect of the invention, the mounting plate may have rounded corners instead of square corners as in a rectangular mounting plate. Such a mounting plate is less likely to rub again or abrade the material surrounding the mattress core, a material known in the industry as upholstery.

In accordance with another aspect of the invention, the mounting plate may have reinforcing ribs between openings therein. Although such a mounting plate may be still flexible, it provides desirable rigidity for effectively and quietly transferring vibration from the massage motor to the mattress.

These and other objects and advantages of the present invention will become more readily apparent during the following detailed description taken in conjunction with the drawings herein.

DETAILED DESCRIPTION OF THE INVENTION

Figure 1:
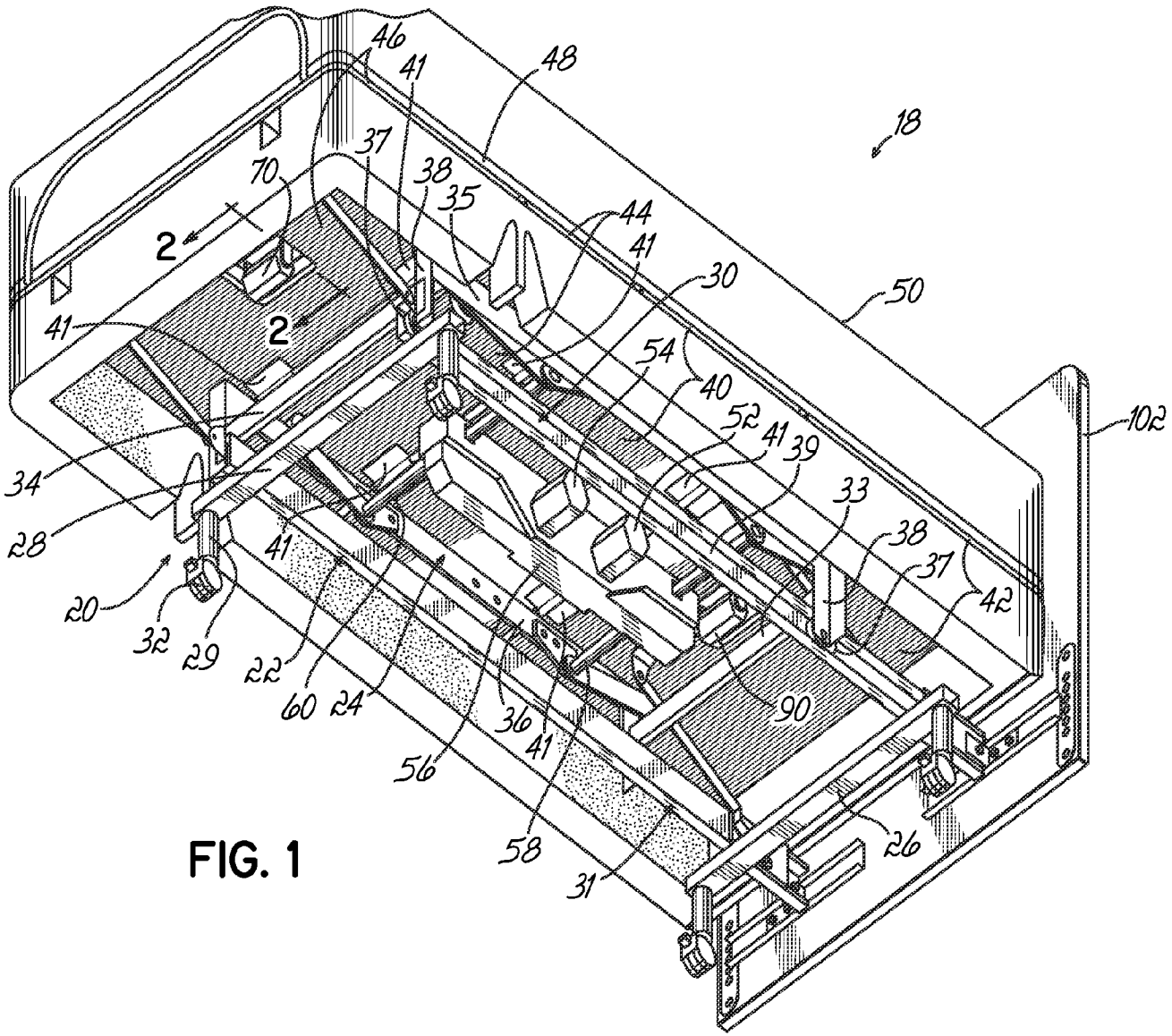
FIG. 1 is a perspective view of an adjustable bed with associated mattress components in accordance with the principles of the present invention.

Referring to FIG. 1, an adjustable bed 18 includes a bed frame 20 comprised of a lower frame 22 and an upper frame 24 movably mounted on the lower frame 22. The lower frame 22 has head and foot end rails 26, 28 respectively, and left and right side rails 30, 31, respectively. The rails 26-31 are joined at their ends to form a generally rectangular lower frame 22. The lower frame 22 at the head end is joined to a head board 102. See FIG. 1. A plurality of caster brackets 29 are secured to and extend down from the end rails 26, 28 of the lower frame 22. A plurality of casters 32, each having a stem (not shown) are received inside the caster brackets 29 for supporting the adjustable bed 18 on the floor and enabling the adjustable bed 18 to be rolled from location to location.

The upper frame 24 includes a head rail 33, a foot rail 34 and left and right side rails 35, 36, respectively. The rails 33-36 are rigidly connected at their ends with fasteners to form the generally rectangular upper frame 24. The upper frame side rails 35-36 are made of angle stock, and the upper frame 24 is movably mounted on the lower frame 22 by four wheels 37 which are rotatably mounted to the ends of legs 38. The wheels 37 ride in C-shaped channels or tracks 39 forming the left and right lower frame side rails 30, 31, respectively.

Figure 3:
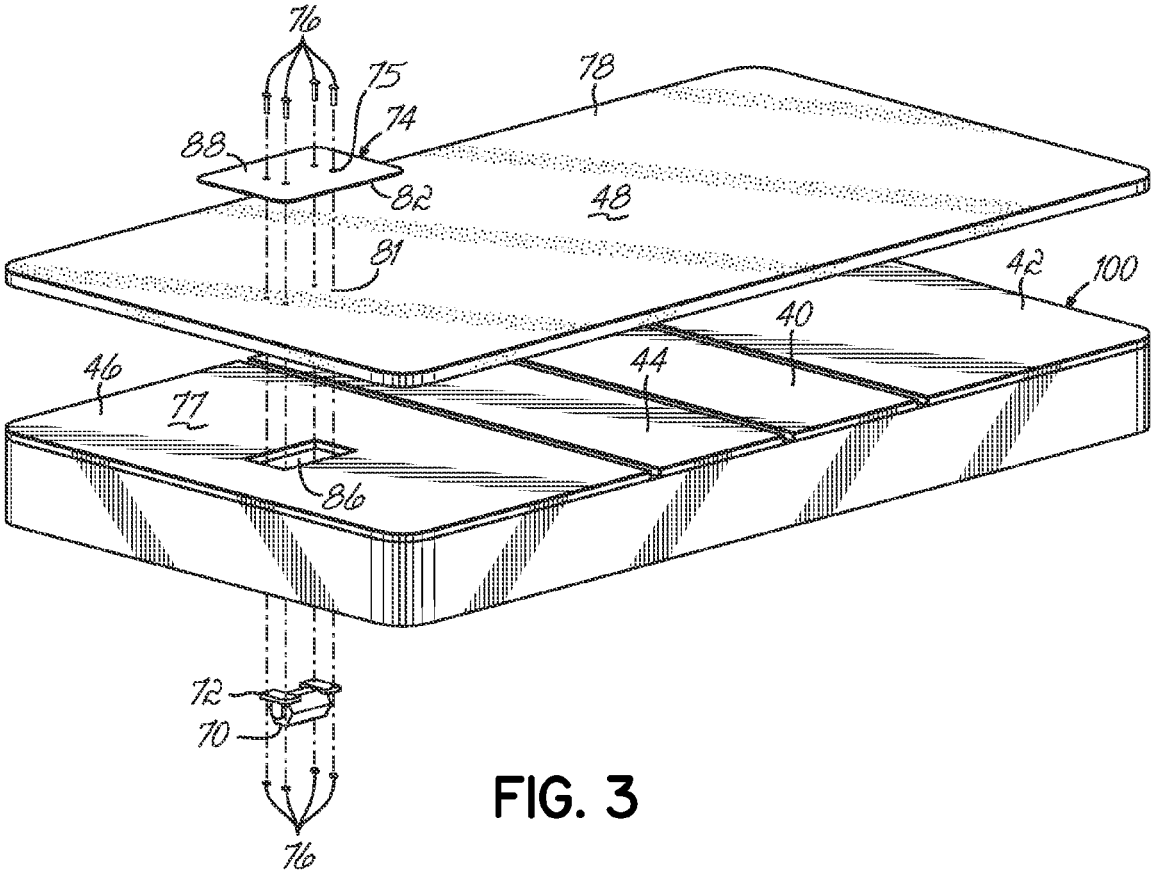
FIG. 3 is a disassembled perspective view of the adjustable bed of FIG. 1.

As best illustrated in FIG. 3, an articulated mattress support platform 100 comprises a first or center support board or section 40 connected to the upper frame 24, and a head support board or section 42 pivotally connected to a head end of the center supporting section 40 with hinges 41. A thigh support board or section 44 is pivotally connected to a foot end of the center support section 40 by hinges 41; and a foot supporting board or section 46 is pivotally connected to a foot end of the thigh supporting section 42 by hinges 41. The supporting sections 40-46 may be made from any desired material that is capable of properly supporting a user on a mattress, for example, a plywood or OSB material. The supporting sections 40-46 are normally 0.625 inch thick but may be other thicknesses as is required.

Figure 2:
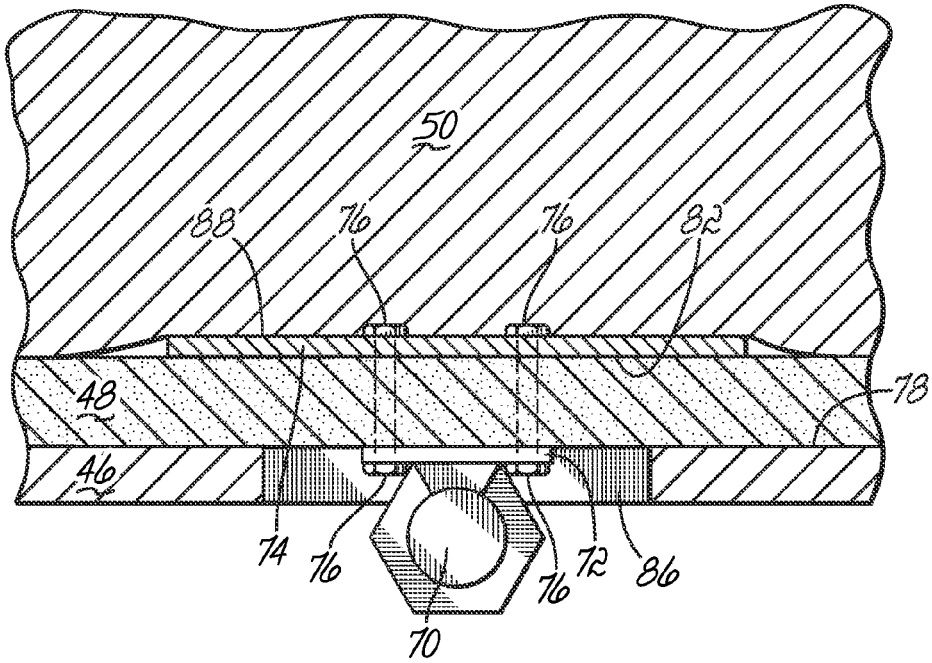
FIG. 2 is a partial cross-sectional view taken along line 2-2 of FIG. 1 and illustrates a massage motor mounting in accordance with the principles of the present invention.

A mattress base or pad 48, for example, a one inch foam pad, is mounted over and covers the head, center, thigh and foot support boards 40-46. Normally, the boards 40-46 and mattress pad 48 are enclosed within a covering (not shown). As shown in FIGS. 1 and 2, a mattress 50 is then laid over the mattress pad 48.

As shown in FIG. 1, head and thigh motors 52, 54, respectively, are mounted to a drive assembly 56 which mechanically couples the head and thigh motors 52, 54 to respective head and thigh torque tubes 58, 60 in a known manner. Operating the head motor 52 rotates the torque tube 58 and raises the head platform 42. With the bed of FIG. 1, as the head platform 42 is raised, the upper frame 24 translates toward the head end the bed; and the head platform 42 remains close to the headboard 117. Operating the thigh motor 54 rotates the thigh torque tube 60 and raises the junction of the thigh and foot platforms 44, 46, respectively.

Referring to FIGS. 2 and 3, a mounting plate 74 rests on top of the mattress base 48. The mounting plate 74 has four holes 75 therethrough for receiving fasteners 76. A massage motor 70 having base plates 72 is rigidly connected to the mounting plate 74 with fasteners 76 and suspended from the mounting plate 74. The mounting plate 74 has a lower surface 82 which contacts the upper surface 78 of the mattress pad 48.

The mounting plate 74 may be made of any suitable material to which the massage motor 70 may be attached, for example, semi-flexible plastic. The mounting plate 74 resides on an upper surface 78 of the mattress pad 48. If desired, washers (not shown) may be located between the mounting plate 74 and the base plates 72 of the massage motor 70. As best seen in FIG. 3, fasteners 76 extend through holes 75 in the mounting platform 74, holes 81 formed in the mattress pad 48 and base plates 72 of the massage motor 70 before being secured with a nut 76. The fasteners 76 may be any suitable fastener, for example, a threaded screw or bolt and a mating nut 76. See FIGS. 2 and 3.

The massage motor 70, suspended from the mounting plate 74 with fasteners 76, extends through an opening 86 within the foot section 46 of the articulated platform 100. The mattress pad 48 is placed over the upper surface 77 of the articulated platform section 100.

When the message motor 70 is turned on, it transfers its vibrations to the mounting plate 74 and ultimately to the mattress 50. Since the mounting plate 74 is not rigidly fixed to the articulated platform 100 or any section thereof, the mounting plate 74 is relatively free to oscillate or vibrate as necessary based on the action of the massage motor 70 The mounting plate 74 supplies a substantially greater vibration to the mattress 50 than would otherwise be possible if the mounting plate 74 were rigidly connected to the articulated platform 100. Any contact between the mounting plate 74 and the articulated platform 100 may result in an undesirable and distracting vibrating noise.

The mattress pad 48 simply lays over the upper surface 77 of the support platform 46. The mattress pad 48 can be made of any soft material such as a fiber or foam, for example, a one inch thick urethane foam having a density of approximately 1.8 and an I.L.D. of from approximately 30 pounds to approximately 35 pounds. While the mattress pad 48 in nominally 1 inch thick, it can have a thickness in the range of from approximately 0.500 inch to approximately 3 inches.

Thus, with the massage motor mounting illustrated in FIGS. 2 and 3, the vibrations of the massage motor 70 are more effectively transferred to a user resting on the mattress 50 than has heretofore been possible. In FIGS. 2 and 3, the mounting of the motor 70 was described with respect to the foot section 46 of the articulated platform 100. As will be appreciated, the mounting of massage motor 90 (FIG. 1) with respect to the head section 40 is identical to that described in FIG. 2. Thus, the mounting of the massage motor 70 as illustrated in FIG. 2 may be used with respect to any of the bed platform sections 40-46. The bed 18 of the present invention provides a simpler and less expensive construction that provides a more effective massage action.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the massage motor mounting of this invention is described with respect to a "wallhugger" adjustable bed. As will be appreciated, the same massage motor mounting may be applied to other adjustable bed designs which are not of the "wallhugger" type. In addition, where appropriate, for example, where a platform construction is used instead of a box spring, the same massage motor mounting and cover may be applied to nonadjustable bed designs.

In the described embodiment with respect to FIG. 1, massage motors are attached to the head section 42 and the foot section 46, as will be appreciated, the massage motor mounting of FIG. 3 may be used with massage motors mounted to the thigh section 44 or the center section 40 of the articulated platform 100.

Figure 4:
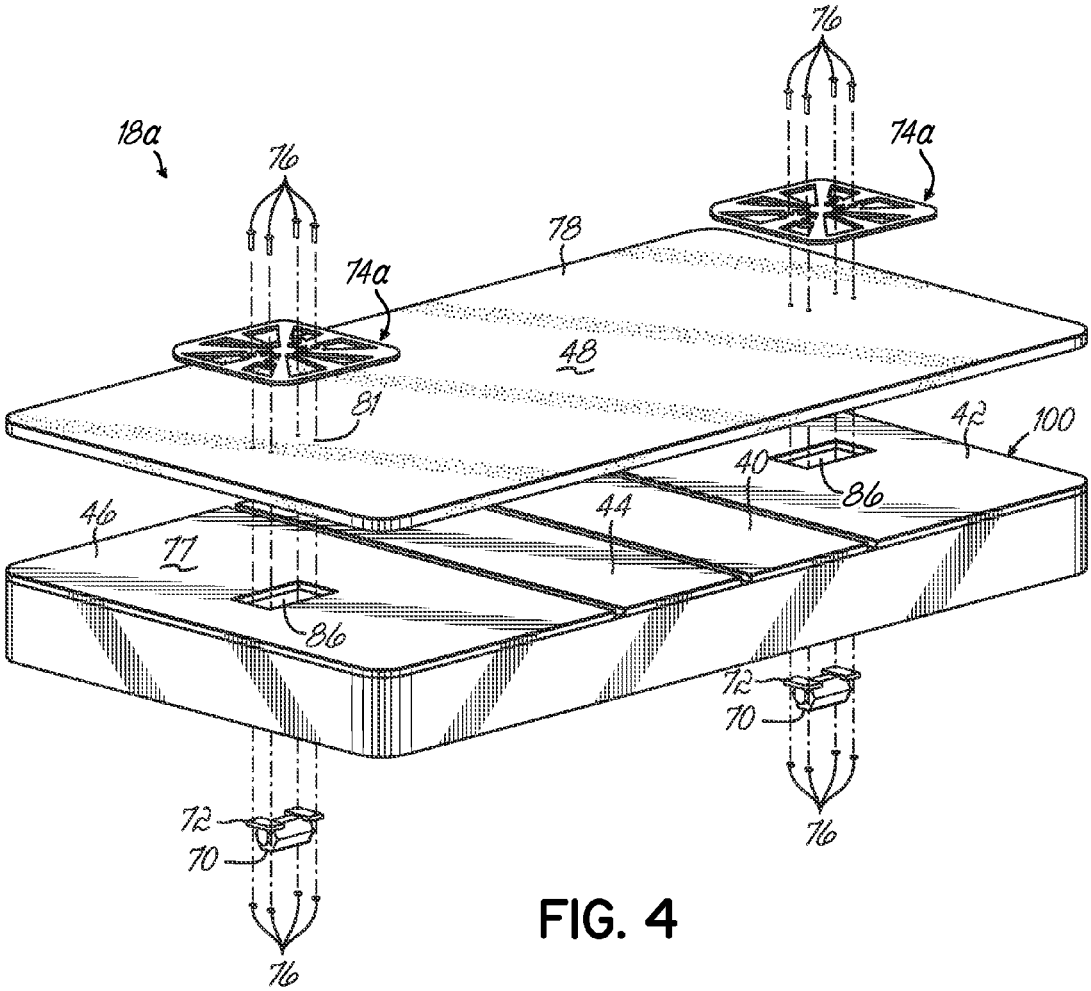
FIG. 4 is a disassembled perspective view of an alternative embodiment of the adjustable bed according to the present invention.
Figure 5:
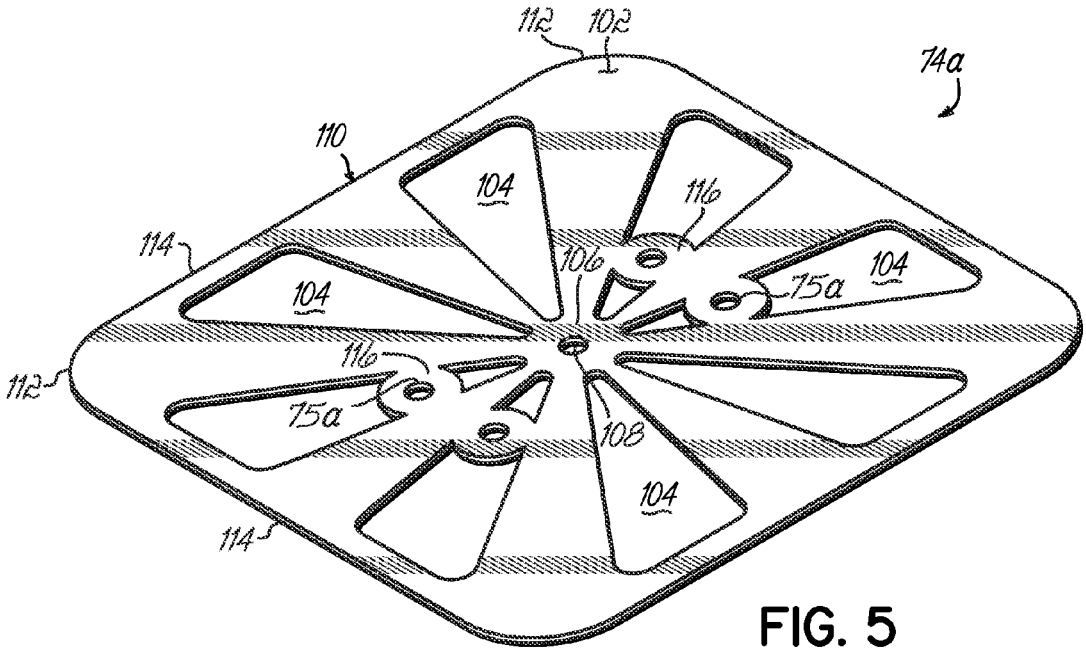
FIG. 5 is a perspective view of the top surface of a mounting plate used in the adjustable bed of FIG. 4.
Figure 6:
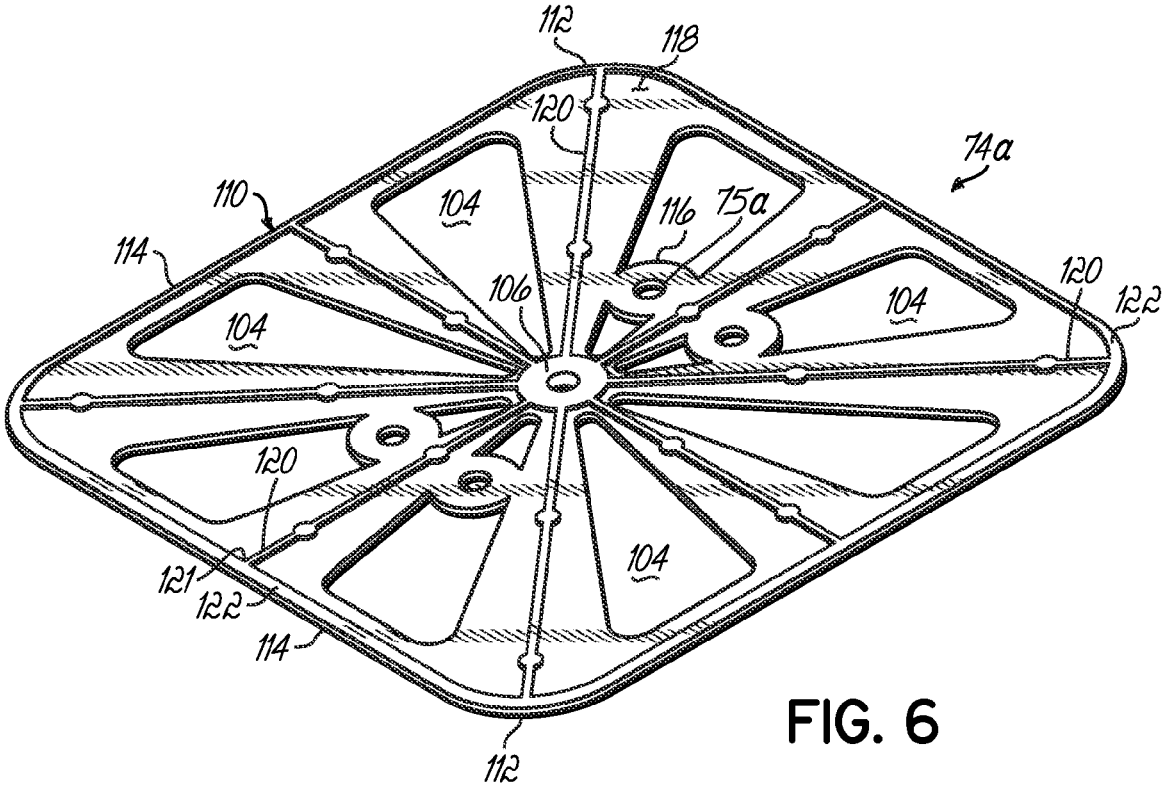
FIG. 6 is a perspective view of the bottom surface of the mounting plate of FIG. 5.

FIGS. 4-6 illustrate an alternative embodiment of adjustable bed 18*a* in accordance with the present invention. In this embodiment two mounting plates 74*a* along with two massage motors 70 are used. However, this embodiment may be used with any number of massage motors 70 in any desired locations. As shown in FIG. 4, two massage motors 70 are suspended from two mounting plates 74*a* with fasteners 76 which extend through openings 86 within the head and foot sections 42, 46, respectively, of the articulated platform 100. The parts and method used to secure the mounting plates 74*a* in positions above the mattress pad 48 may vary from that described above, if desired.

FIG. 5 illustrates a top or upper surface 102 of one of the mounting plates 74*a*. The mounting plate 74*a* has a plurality of generally triangular openings 104 therein generally extending outwardly from a central core 106 having a center hole 108. The mounting plate 74*a* is generally rectangular is shape but has a perimeter 110 with rounded corners 112 and straight edge walls 114. A plurality of holes 75*a* are located in fillers 116 located generally in the generally triangular openings 104. Although holes 75*a* are illustrated as being in specific locations, they may any other desired locations and are adapted or sized to allow fasteners 76 to pass through them.

FIG. 6 illustrates a bottom or lower surface 118 of one of the mounting plates 74*a*. This view of the mounting plate 74*a* illustrates a plurality of reinforcing ribs 120 and a perimeter rib 122. Each of the reinforcing ribs 120 extends from the central core 106 outwardly between the generally triangular openings 104 and terminates intersecting with the perimeter rib 122 at intersection 121. As those skilled in the art will appreciate, any other designs may used for the mounting plates. Applicant does not intend to limit the mounting plate to any one configuration, shape or design.

Therefore, the invention in its broadest aspects is not limited to the specific detail shown and described. Consequently, departures may be made from the details described herein without departing from the spirit and scope of the claims which follow.

What is claimed is:

1. An adjustable bed comprising:

a bed frame;

a first support section supported by the bed frame;

a second support section having one end pivotally attached to one end of the first support section;

a mattress pad overlaying said first and second support sections;

a mounting plate having at least one opening therein located above the mattress pad, a massage motor suspended from the mounting plate.

2. The adjustable bed of claim 1 wherein the mattress pad has a thickness of approximately one inch.

3. The adjustable bed of claim 1 wherein the mattress pad has a thickness in the range of from approximately 0.500 inch to approximately 3 inches.

4. The adjustable bed of claim 1 wherein the mounting plate is mounted to the massage motor without contacting the support sections.

5. The adjustable bed of claim 1 wherein the mounting plate has reinforcing ribs.

6. The adjustable bed of claim 1 wherein the mattress pad is made of fiber.

7. The adjustable bed of claim 1 wherein the mattress pad is made of foam.

8. The adjustable bed of claim 1 wherein the second support section has an opening therethrough for receiving the massage motor suspended from the mounting plate.

9. The adjustable bed of claim 1 wherein the second support section comprises:

a thigh support section having one end pivotally connected to the opposite end of the first support section; and a foot support section having one end pivotally connected to an opposite end of the thigh center support section and the foot support section has an opening therethrough for receiving the massage motor suspended from the mounting plate.

10. The adjustable bed of claim 1 wherein the second support section is a head support section and the head support section has an opening therethrough for receiving the massage motor suspended from the mounting plate.

11. The adjustable bed of claim 1 further comprising:

a third support section having one end in mechanical communication with an opposite end of the first support section;

a second mounting plate located above the third support section; and a second massage motor suspended from the second mounting plate.

12. The adjustable bed of claim 11 further comprising a fourth support section having one end pivotally connected to the opposite end of the first support section and another end pivotally connected to an end of the third support section.

13. An adjustable bed comprising:

a bed frame;

a center support section supported by the bed frame;

a second support section having one end pivotally attached to one end of the center support section, the second support section having an opening therethrough;

a mattress pad overlaying said center and second support sections;

a mounting plate having rounded corners resting on said mattress pad;

a massage motor mounted to the mounting plate and extending through the opening in the second support section.

14. The adjustable bed of claim 13 wherein the mattress pad has a thickness of approximately one inch.

15. The adjustable bed of claim 13 wherein the mounting plate contacts a mattress laying on the mattress pad.

16. The adjustable bed of claim 13 wherein the mattress pad is made of foam.

17. The adjustable bed of claim 13 wherein the mattress pad is made of fiber.

18. An adjustable bed comprising:

a bed frame;

an articulated support platform supported by the bed frame;

a mattress pad overlaying said support platform;

a mounting plate having at least one opening therein located above the mattress pad; and a massage motor suspended from the mounting plate.

19. The adjustable bed of claim 18 wherein said mounting plate is not secured to said support platform.

* * * * *